United States Patent [19]

Kline

[11] 4,426,914

[45] Jan. 24, 1984

[54] AXIAL PISTON PUMP

[75] Inventor: William L. Kline, Galena, Ohio

[73] Assignee: The Kline Manufacturing Company, Galena, Ohio

[21] Appl. No.: 295,826

[22] Filed: Aug. 24, 1981

[51] Int. Cl.[3] ..... F01B 13/04

[52] U.S. Cl. ..... 91/487; 91/499

[58] Field of Search ..... 91/487, 488, 499, 506

[56] References Cited

U.S. PATENT DOCUMENTS

| | | | |
|---|---|---|---|
| 2,642,810 | 6/1953 | Robinson | 91/499 |
| 2,915,985 | 12/1959 | Budzich | 417/222 |
| 3,126,835 | 3/1964 | Kline | 91/507 |
| 3,160,109 | 12/1964 | Kline | 91/487 |
| 3,405,646 | 10/1968 | Thoma | 91/499 |
| 4,232,587 | 11/1980 | Kline | 91/499 |

FOREIGN PATENT DOCUMENTS

| | | | |
|---|---|---|---|
| 2616985 | 11/1976 | Fed. Rep. of Germany | 91/499 |
| 54-47903 | 3/1979 | Japan | 91/499 |

*Primary Examiner*—William L. Freeh

*Attorney, Agent, or Firm*—Wilson, Fraser, Barker & Clemens

[57] ABSTRACT

An improved fluid pressure energy translating device of the axial piston type including a cylinder barrel mounted on a drive shaft. The cylinder barrel is centered on the drive shaft by a crowned bearing on the drive shaft and coupled through a splined connection which includes crowned male splines on the drive shaft. The crowned bearing and the crowned male splines on the drive shaft have centers located to either side to the center of bending of the drive shaft under load so as to eliminate tilting of the barrel.

6 Claims, 8 Drawing Figures

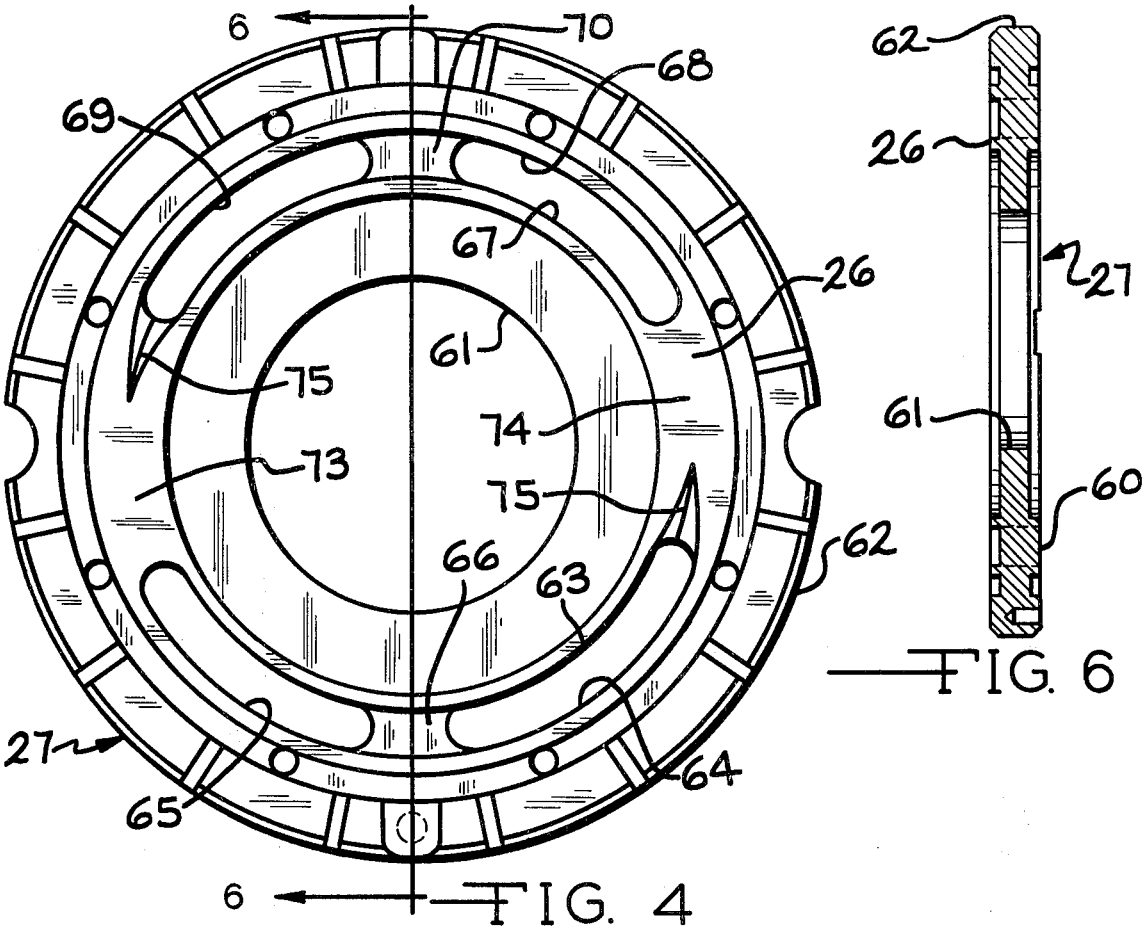
FIG. 6
FIG. 4
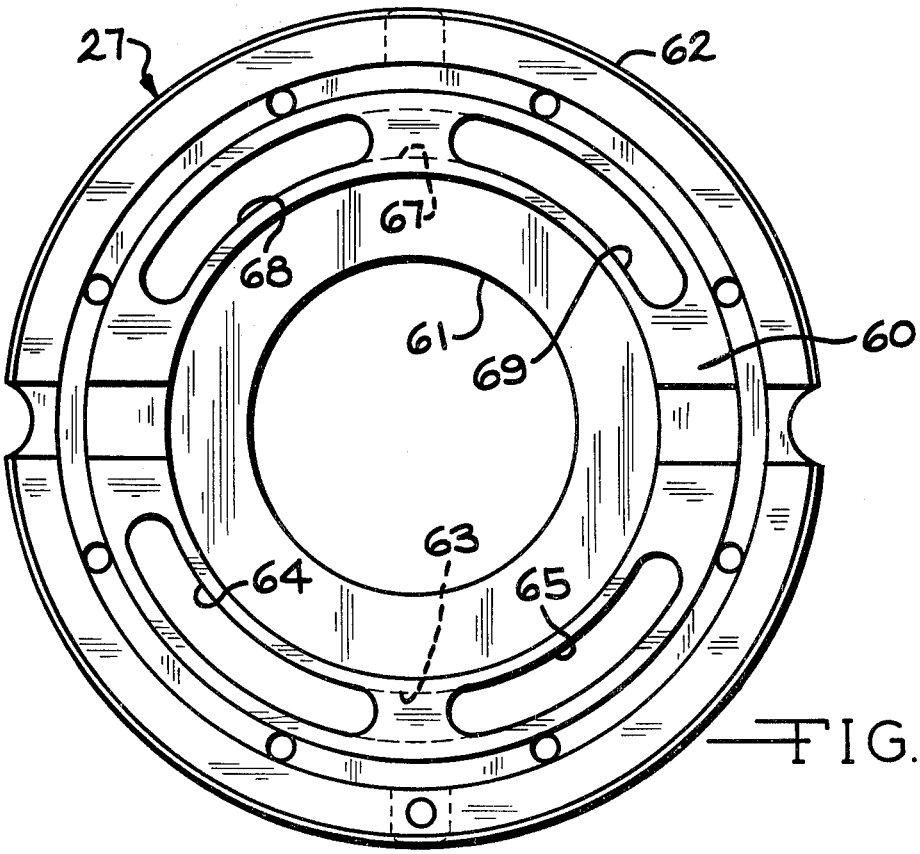
FIG. 5

AXIAL PISTON PUMP

BACKGROUND OF THE INVENTION

This invention relates to a fluid pressure energy translating device and more particularly to an improved high pressure hydraulic axial piston pump or motor.

Such axial piston pumps or motors generally comprise an annular block or barrel defining a plurality of cylinders arranged concentrically of the barrel axis which each slidably receives one of a like plurality of pistons. The pistons are operatively connected through spherical bearings disposed with shoes to an inclined wobble plate or cam plate disposed adjacent one end of the barrel. The shoes slide on the stationary cam plate as the barrel is rotated. Reciprocation of the pistons in response to relative rotation between the cam plate and the barrel is thus effected. The barrel is supported on a drive shaft for rotation about its axis and about a fixed valve or port plate which engages the end of the barrel opposite the cam plate. The port plate has a pair of ports or passages for connection, respectively, to a source of fluid and to a discharge line. The ports in the port plate register with a plurality of spaced-apart ports in the barrel face which communicate with the individual cylinders so that fluid will be alternately introduced into and discharged from each cylinder as the barrel is rotated and the pistons reciprocate.

In order to maintain a fluid seal between the rotating barrel and the fixed port plate, the mating surfaces must be extremely flat and perfectly parallel. Typically, the mating surfaces are flat to within two lightbands of flatness. Furthermore, proper axial alignment between the barrel and the port plate must be maintained. If the barrel and port plate slightly axially misalign, i.e., tilt relative to one another, increased wear of the mating surfaces on the port plate and the barrel will occur. If the tilt is great enough, system pressure will act on usually unexposed area causing barrel/port plate separation or "blowoff".

This problem is both significant and difficult to solve since not only is it dynamic, i.e., dependent upon speed and other operating conditions but it is also the result of several forces acting upon the barrel. Fluid pressurization and pumping by the pistons is accomplished by interaction between the cam plate and piston shoes. The force which the cam plate exerts on each of the piston shoes to pump fluid is balanced by a reaction force in the opposite direction. Due to the inclination of the cam plate, this axial reaction force produces a radial component of force tending to move the piston shoes radially away from the barrel axis and the cam plate. The forces from each of the piston shoes may be resolved into a single resultant force acting on the barrel and extending radially from the barrel axis at the point of intersection of the barrel axis and the plane of loci of the centers of the spherical bearings. It should be noted that the magnitude of this force is proportional to the hydraulic fluid pressure. It is thus not only dynamic but also independent of the rotational speed of the barrel.

A second force tending to tilt the barrel results from centrifugal force. The centers of gravity of some of the different pistons located around the barrel are axially offset from the diametrically opposed pistons. The centrifugal force on each piston acts through the center of gravity of the piston in a direction radially of the barrel. Since the centers of gravity of some of the pistons are axially offset from others, an unbalanced centrifugal force is applied to the barrel. The centrifugal force on diametrically opposed offset pistons applies a dynamic couple to the barrel which is the product of the centrifugal force acting on one of the pistons times the axial offset of the centers of gravity of the pistons. The magnitude of this couple will vary from zero in the case of opposed pistons in which the centers of gravity are aligned at right angles to the shaft to a maximum value in the case of opposed pistons in their maximum offset position. The magnitude of the couple is also directly related to speed.

A general solution to these problems which has been incorporated into the design of most contemporary axial piston pumps comprehends restraining either the barrel or port plate while permitting the other a certain amount of orientation freedom. Through this approach, barrel-valve plate misalignment which might result in leakage and blow-off is minimized since tilting or skewing of one of the elements may be accommodated by movement of the other. Another approach is disclosed in my prior U.S. Pat. No. 3,126,835. By supporting the barrel on a bearing on a drive shaft extending coaxially through the barrel and by properly locating the bearing, the effects of the dynamic couple formed from centrifugal force may be offset at least in part by the effects of the resultant force from fluid pressure acting on the pistons.

The unequal forces acting on the barrel also tend to slightly deflect the drive shaft which supports the barrel. If the barrel is rigidly connected to the drive shaft and the drive shaft deflects or bends slightly under loading, the barrel will tilt relative to the port plate and a loss of fluid pressure will occur. In my prior U.S. Pat. Nos. 3,126,835 and 3,160,109, a loss of fluid pressure resulting from deflection or bending of the drive shaft is reduced through the use of a torque tube interconnecting the drive shaft with the barrel and through the use of a crowned bearing between the drive shaft and the barrel. The torque tube extends coaxially along the drive shaft between the drive shaft and the barrel and has one end connected through splines to the drive shaft and an opposite end connected through splines to the barrel. As the shaft is driven, the torque tube in turn drives the barrel. The splines between the drive shaft and the torque tube and between the torque tube and the barrel also may be crowned to allow the shaft to flex relative to the barrel without tilting the barrel, as taught in my U.S. Pat. No. 4,232,587. As the drive shaft flexes under loading, the barrel is permitted to slide on the port plate without tilting away from the port plate. This construction has been effective in greatly reducing or eliminating tilting of the barrel and the resulting hydraulic fluid leakage.

In recent years, hydraulic component applications in various industries have become increasingly taxing. For example, axial piston pumps and motors are being asked to far exceed their design capabilities. Increases in both hydraulic pressure and rotational speeds are causing much higher rates of failure in axial piston pumps and motors. Failures primarily occur in the form of barrel-valve plate separation resulting in a loss in pressure of "blow-off" and loss of shoe contact with the surface of the cam plate.

Early axial piston pumps provided a direct drive between the drive shaft and the barrel. In one early design shown in U.S. Pat No. 2,642,810, the drive shaft was connected directly to the barrel through a splined connection having crowned or curved male splines on the drive shaft engaging straight splines on the barrel. As a consequence of the crowned splines, flexing of the drive shaft would not automatically tilt the barrel away from the port plate. However, since no bearing surface was provided between the drive shaft and the barrel, the direction of the tilting forces on the barrel due to centrifugal force and the direction of the tilting forces on the barrel due to fluid pressure acting on the pistons was cumulative, rather than subtractive as in the pumps shown in my above-described U.S. Pat. No. 3,126,835. Consequently, there was still a great tendency for barrel tilting relative to the port plate to occur in the pump shown in the U.S. Pat. No. 2,642,810 under high fluid pressure and high operating speed conditions. Another pump design shown in U.S. Pat. No. 2,915,985 provides both a straight spline connection and a spherical bearing connection between the drive shaft and the cylinder barrel. However, the straight spline connection prevents bending of the drive shaft relative to the barrel so that any flexing of the drive shaft under load is transferred through the splines to the barrel to cause the barrel to tilt away from the port plate.

SUMMARY OF THE INVENTION

According to the present invention, an improved axial piston hydraulic device is provided for operation either as a pump or a motor. The pump or motor provides a direct spline connection between a drive shaft and the barrel, allowing the pump to be adapted to higher operating speeds and loads. A bearing surface between the drive shaft and the barrel is also provided. According to the present invention, both the bearing and the male splines on the drive shaft are slightly crowned in the direction of the drive shaft axis. The drive shaft is designed such that when it flexes or bends under loading, the center of bending or curvature is located between the centers of the crowned spline and the crowned bearing. Furthermore, the crowned bearing is located on the drive shaft such that a plane defined by the loci of centers of the spherical connections between the pistons and the shoes which slide on the cam plate intersects the drive shaft axis at a point located between the center of the crowned bearing and the center of the crowned spline. Consequently, the resultant force acting upon the barrel to tilt the barrel caused by the fluid pressure exerted between the pistons and cam acts in an opposite direction from the couple produced by centrifugal forces acting upon the axially displaced opposing pistons. Although forces on the barrel cause flexing of the drive shaft under high operating speeds and loads, the locations of the centers of the crowned bearing and the crowned spline on opposite sides of the center of shaft bending allow the barrel to slide on the port plate rather than to tilt away from the port plate and cause a loss in fluid pressure.

Accordingly, it is an object of the invention to provide an improved axial piston hydraulic device capable of operation as a pump or a motor.

Another object of the invention is to provide an axial piston hydraulic device capable of operating at relatively high speeds under high fluid pressures without the loss of fluid pressure due to tilting of the cylinder barrel.

Other objects and advantages of the invention will become apparent from the following detailed description, with reference being made to the accompanying drawings.

BRIEF DESCRIPTION OF THE DRAWINGS

FIG. 4 is a cross-sectional view taken along line 4—4 of FIG. 2;

FIG. 5 is a cross-sectional view taken along line 5—5 of FIG. 2;

FIG. 6 is a cross-sectional view taken along line 6—6 of FIG. 4;

DESCRIPTION OF THE PREFERRED EMBODIMENTS

Figure 1:
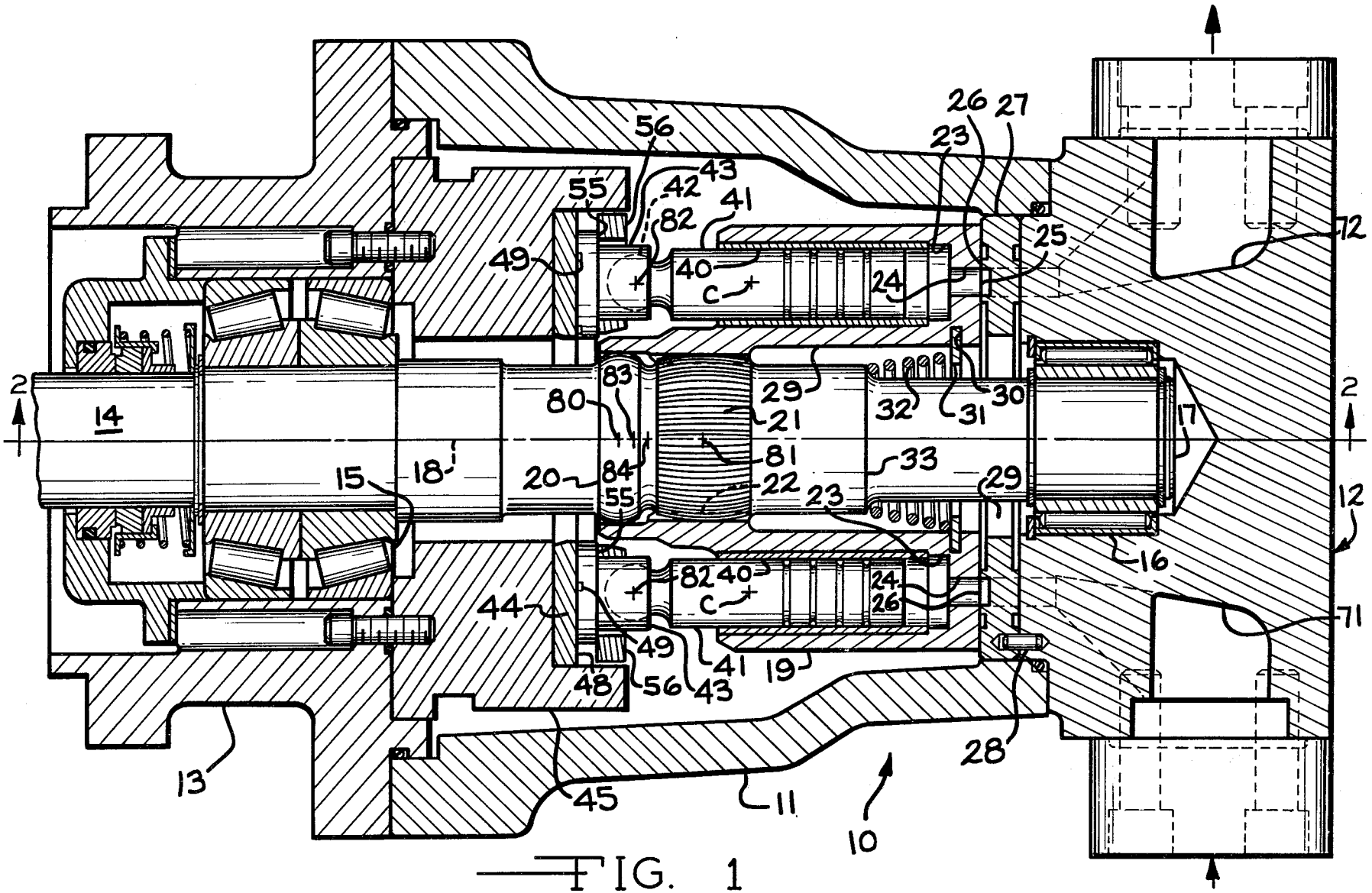
FIG. 1 is a side elevational, cross-sectional view of a hydraulic device constructed in accordance with the present invention.
Figures 2, 3:
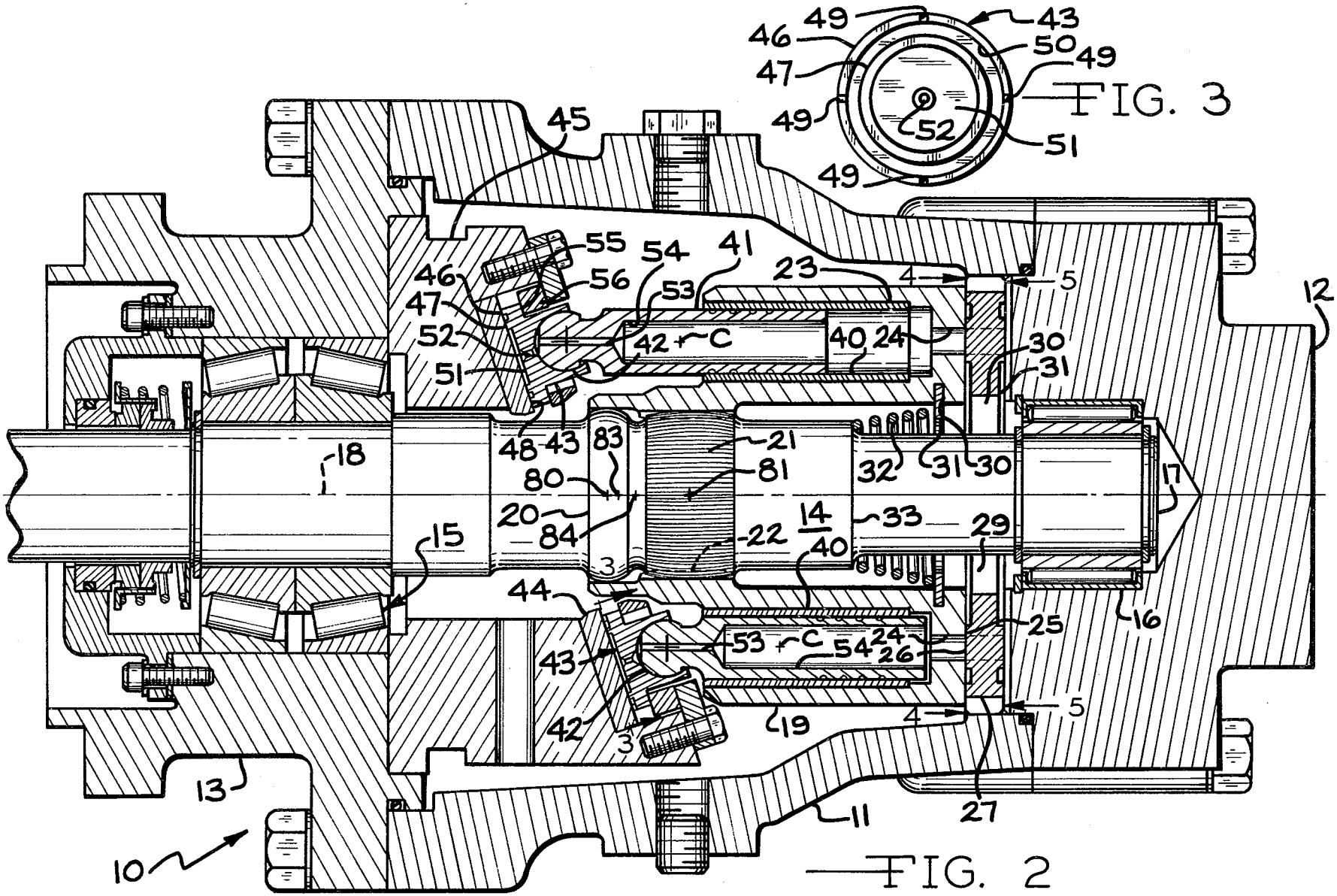
FIG. 2 is a cross-sectional view taken along line 2—2 of FIG. 1.
FIG. 3 is a cross-sectional view taken along line 3—3 of FIG. 2 and showing details of the shoe lands which ride on the cam plate.

Referring now to the drawings and particularly to FIGS. 1 and 2, a high pressure axial piston hydraulic pump 10 is illustrated in accordance with the preferred embodiment of the invention. It should be understood that the pump 10 is a fluid energy translating device which may be operated as either a pump or a motor. The pump 10 is capable of high pressure continuous duty operation and, for example, may be operated at pressures on the order of 5,000 psi or more for extended periods of time.

The pump 10 includes a tubular or annular housing body 11 having one end closed by a port cap 12 and an opposite end closed by a flange mount or base 13. A drive shaft 14 extends through the base 13 into the housing body 11. A radial thrust bearing 15 supports the drive shaft within the base 13 and a bearing 16 supports an end 17 of the drive shaft 14 within the port cap 12.

The shaft 14 has an axis 18 about which it rotates when it is driven by a suitable external power source (not shown). A cylinder barrel 19 is disposed concentrically about the shaft 14. The barrel 19 contacts the surface of a crowned bearing 20 formed integrally on the shaft 14 and engages a set of crowned male splines 21 integrally formed on the drive shaft 14. The male splines 21 engage a set of straight female splines 22 formed on the barrel 19 to drivingly couple the barrel 19 to the drive shaft 14.

The barrel 19 defines a plurality of cylinders 23 which are uniformly spaced from the axis 18 and also are uniformly spaced circumferentially about the barrel 19. Each cylinder is connected through an independent passage 24 to an end surface 25 of the barrel 19. The barrel end surface 25 abuts a surface 26 on a valve or port plate 27. The port plate 27 is positioned between the barrel 19 and the port cap 12 and is indexed to the port cap 12 with a pin 28. The barrel 19 also defines a central cavity 29 having an annular groove 30 disposed generally adjacent the end surface 25. A snap ring 31 is seated in the annular groove 30 and provides axial restraint for one end of a compression spring 32. The other end of the compression spring 32 engages a shoulder 33 on the shaft 14. Since the shaft 14 is axially restrained by the radial thrust bearing 15, the compression spring 32 exerts a force on the barrel 19 to bias the barrel 19 against the port plate 27. During startup and during zero pressure operation, a fluid tight seal between the stationary port plate 27 and the rotating barrel 19 is maintained by the spring force exerted on the barrel 19 by the compression spring 32. Under load, hydraulic pressure maintains the barrel 19 against the port plate 27.

Each of the cylinders 23 within the barrel 19 is partially lined with a sleeve 40 fabricated of suitable bearing material. A piston 41 is slidably disposed within each cylinder sleeve 40. Each piston 41 has a ball or spherical end 42 which rotates within a corresponding socket in a shoe 43. The shoes 43 ride on a cam plate 44 which is disposed at a fixed angle relative to the axis 18 within a stationary support 45. The cam plate 44 is free to rotate within the stationary support 45. Operated as a pump, the shaft 14 rotates the barrel 19 and the shoes 43 ride on the cam plate 44 to reciprocate the pistons 41 within the cylinder sleeves 40. The stationary support 45 and fixed angle of the cam plate 44 provide a fixed displacement for the pump 10. It will be appreciated that the cam plate 44 may be adjustably supported in order to provide a variable displacement for the pump 10, as is illustrated, for example, in my prior U.S. Pat. No. 3,126,835 and in other prior art.

Details of the shoes 43 are shown in FIGS. 2 and 3. Each shoe 43 has an outer annular tilt land 46 and an inwardly spaced annular balance land 47 which ride on a flat surface 48 on the cam plate 44. A plurality of radial slots 49 extend through the tilt land 46, and may, for example, be spaced 90° apart about the tilt land 46. An annular oil groove 50 is located between the two annular lands 46 and 47.

A central region 51 interior of the balance land 47 is spaced from the cam plate surface 48. In the center of the central region 51, an oil passage 52 is located for communicating with an oil passage 53 within the piston 41 connected to the shoe 43. During the pressure stroke of the connected piston 41, a small amount of the hydraulic fluid being pumped is forced through a hollow center 54 in the connected piston 41, the piston passage 53, the shoe passage 52 to the central region 51 is between the shoe 43 and the cam plate 44. From the central region 51, a small amount of the hydraulic fluid flows between the balance land 47 on the shoe 43 and the cam plate surface 48 and then through the oil groove 50 and out the grooves 49 in the tilt land 46. The limited oil flow provides pressure balance of the forces on the shoes 43 and also produces a hydrostatic bearing between the cam plate surface 48 and the shoes 43 which permits them to readily slide over the cam plate surface 48 while under load.

The outer surface of each shoe 43 is provided with a step 55 which is engaged by an annular retainer 56 which is parallel to the surface 48. The spacing between the retainer 56 and the cam plate surface 48 is only slightly greater than the thickness of the steps 55 on the shoes 43 so that the shoes 43 are free to rotate and slide on the cam plate 44 but are held in close contact with the cam plate 44. In prior art axial piston pumps, the shoes were generally formed from a bearing material, such as bronze. In the pump 10, the shoes 43 are formed from steel and have a layer of bronze bonded to the lower surface for forming at least the surface portions of the lands 46 and 47 which contact the cam plate surface 48. Since the shoes 43 are primarily formed from steel, problems with metal fatigue are not present and it is unnecessary to provide hydraulic hold down for the pistons 41 to urge the pistons 41 toward the cam plate 44. Such a hydraulic hold down arrangement is illustrated, for example, in my prior U.S. Pat. No. 3,160,109.

Turning now to FIGS. 4–6, details are shown for the valve or port plate 27. The port plate 27 is generally disc-like having a side 26 which contacts the surface 25 on the barrel 19 and having an opposite side 60 which contacts the port cap 12. The port plate 27 further has a central opening 61 which is spaced radially outwardly from the shaft 14 and has a periphery 62 which abuts the housing body 11. A single arcuate intake port 63 is formed in the port plate surface 26. The intake passage 63 communicates with two complementarily disposed arcuate intake passages 64 and 65 which extend through the port plate 27. The passages 64 and 65 are separated by a web 66 which does not extend to the surface 26. Similarly, a single arcuate discharge port 67 is formed in the port plate surface 26 and communicates with two complementarily disposed arcuate discharge passages 68 and 69 which extend through the port plate 27. The passages 68 and 69 are separated by a reinforcement web 70 which is spaced from the surface 26. The intake passages 64 and 65 communicate with an intake passage 71 in the port cap 12 and the discharge passages 68 and 69 communicate with a discharge passage 72 in the port cap 12 (FIG. 1). For purposes of example and illustration, the barrel 19 is assumed to rotate clockwise relative to the port plate 27 in FIG. 4 so that the intake/discharge passage 24 from each cylinder 23 sweeps clockwise over the intake port 63, over a surface region 73 as the piston passes bottom dead center, over the discharge port 67 and then over a surface area 74 as the piston passes top dead center. The leading edges 75 of the ports 63 and 67 are tapered so as to provide a smooth transition as the barrel passages 24 sweep from the surface 74 to the port 63 and from the surface 73 to the port 67.

As previously stated under the description of FIGS. 1 and 2, both the bearing 20 and the male splines 21 on the drive shaft 14 are crowned or curved in profile. The curvature is exaggerated in FIGS. 1 and 2 and may, for example, only be on the order of 0.006 inches or less over the length of the splines 21. The crowned bearing 20 has a center 80 and the crowned male splines 21 have a center 81. The bearing and spline centers 80 and 81 are located on the shaft axis 18. As discussed in my prior U.S. Pat. No. 3,126,835 each piston spherical end 42 had a center of curvature 82. The centers of curvature 82 lie in a plane which intersects the shaft axis 18 at a point 83. The point 83 is located between the crowned bearing center 80 and the crowned spline center 81.

Figure 7:
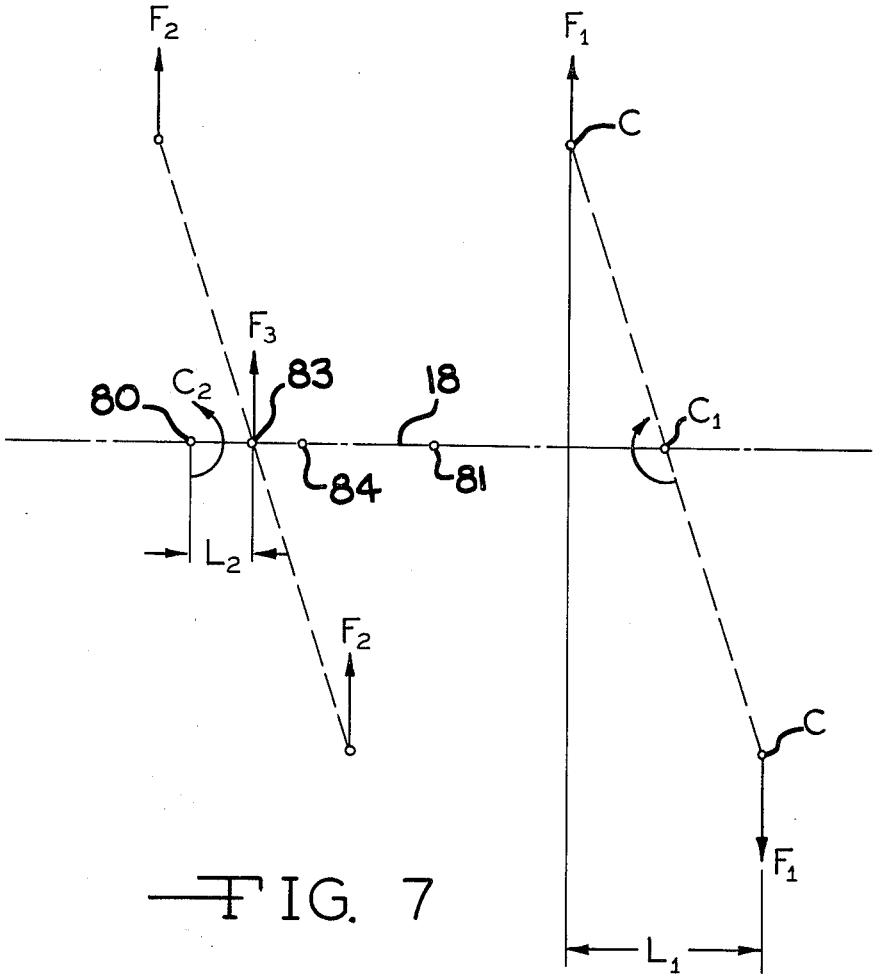
FIG. 7 is a diagrammatic representation of the forces acting on the barrel of an axial piston pump.

FIG. 7 illustrates the forces acting upon the barrel 19 during operation of the pump 10. Each of the pistons 41 has a center of gravity C. As the barrel 19 rotates, a centrifugal force $F_1$ acts on each piston 41 through the center of gravity C of the piston in a direction radially outwardly of the barrel 19. The centrifugal forces $F_1$ on a pair of diametrically opposed pistons offset a longitudinal distance $L_1$, such as the two pistons 41 illustrated in FIG. 2, will thus apply a couple $F_1L_1$ to the barrel 19 which is the product of the centrifugal force $F_1$ acting on one of the pistons 41 times the longitudinal offset $L_1$ of the centers of gravity of the pistons. The magnitude of the couple $F_1L_1$ will vary from zero in the case of opposed pistons in which the centers of gravity C are aligned at right angles to the shaft 14, as is the case of the pistons shown in FIG. 1, to a maximum value in the case of diametrically opposed pistons in their maximum offset position, as shown in FIG. 2 and will also vary directly with speed. From FIG. 7, it can be seen that the couple $F_1L_1$ tends to tilt the barrel in a clockwise direction.

The center 80 of the crowned bearing 20 is offset behind, i.e., to the left of, the point 83 on the shaft axis 18 at which the plane of centers of the ball or spherical ends 42 of the pistons 41 intersects the shaft axis 18. Due to the inclination of the cam plate 44, hydraulic pressure acting at the spherical ends 42 produces a radial force $F_2$ at each spherical end 42. The forces $F_2$ acting upon all of the ends 42 may be resolved into a single force $F_3$ acting at the point 83 on the shaft axis 18. The resultant force $F_3$ is directed radially outwardly of the shaft axis 18 and exerts a moment $F_3L_2$ on the barrel 19 about the center 80 of the crowned bearing 20, where $L_2$ is the distance along the shaft axis 18 from the bearing center 80 to the point 83. The moment $F_3L_2$ will, as is apparent from FIG. 7, tend to tilt the barrel about the bearing center 80 in a counterclockwise direction and in opposition to the dynamic couple $F_1L_1$, by reason of the location of the crowned bearing 20 a predetermined distance $L_2$ behind the point 83, that is, on the opposite side of the point 83 from the forward end of the barrel 19 that abuts the valve plate 27. The predetermined distance $L_2$ between the center of the crowned bearing 20 and the intersection point 83 is selected so that for a given speed of rotation of the barrel 19 and a given inclination of the cam plate 44, the moment $F_3L_2$ will correspond to the dynamic couple $F_1L_1$ and thus substantially eliminate any tendency of the barrel to tilt relative to the shaft axis 18. Therefore, within a reasonable range of pump operation, the location of the crowned bearing 20 to one side of the point of intersection 83 will minimize the tendency of the barrel to tilt, even though the opposing couple $F_1L_1$ and moment $F_3L_2$ are not exactly equal.

When the couple $F_1L_1$ and moment $F_3L_2$ are not equal and do not balance one another, the shaft 14 deflects or bends slightly. Of course, the degree of deflection is dependent upon the magnitude of the resultant forces applied to the shaft 14. In accordance with the present invention, the shaft 14 is constructed such that a point 84 of maximum deflection or bending is located between the crowned bearing center 80 and the crowned spline center 81. Under maximum loads and speeds, the deflection at the point 84 is typically no more than 0.006 inch.

Figure 8:
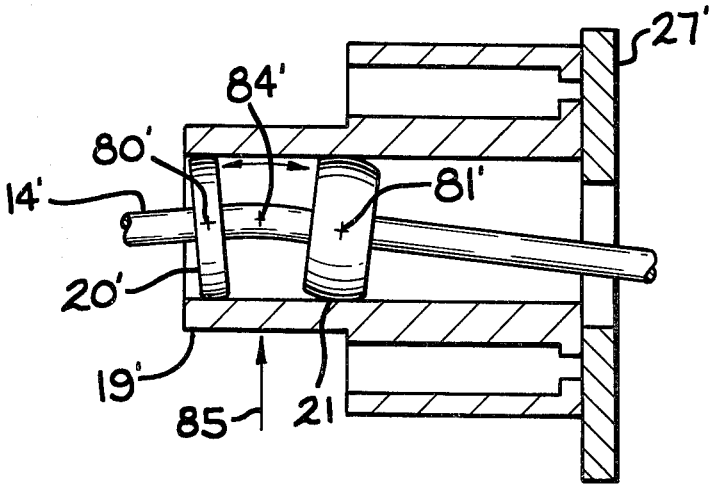
FIG. 8 is a diagrammatic cross-sectional view through the barrel and the valve plate and showing the effects of flexing of the drive shaft under load.

FIG. 8 shows a highly diagrammatic illustration of a drive shaft 14' bending under the load of a resultant force 85 applied by a barrel 19' to the drive shaft 14'. The force 85 causes the shaft 14' to bend about a center point 84' located between the center 80' of a crowned bearing 20' on the shaft 14' and the center 81' of a crowned spline 21' on the shaft 14'. It can be seen that the bending of the shaft 14' causes the axes of rotation of the crowned bearing 20' and the crowned spline 21' to shift out of alignment with one another so that the points of contact between the barrel 19' and the bearing 20' and the splines 21' move on crowned surfaces. Due to the crowned surfaces on the bearing 20' and the spline 21', however, no tilting forces are exerted on the barrel 19' by either the shaft 14', the crowned bearing 20' or the crowned splines 21'. Therefore, the barrel 19' will slide off center on the fixed port plate 27' without tilting. On the other hand, if either the bearing 20' or the splines 21' are straight rather than crowned or if the center of bending 84' of the shaft is not properly located between the centers 80' and 81', a tilting force will be exerted on the barrel 19' which, if it is of sufficient magnitude, will cause barrel to port plate separation.

Turning again to FIGS. 1 and 2, the shaft 14 is manufactured such that it deflects or bends only a small amount during maximum speed and maximum pressure operation of the pump 10, typically less than 0.004 inch over the length of the shaft 14 between the bearings 15 and 16. The deflection of the shaft 14 at the point 84 is normally sufficiently small that the crowned bearing 20 and the crowned splines 21 need only a small curvature. This curvature may be, for example, on the order of only 0.006 inch over the width of the bearing 20 and the width of the teeth forming the male splines 21.

It will be appreciated that various modifications and changes may be made in the above described preferred embodiment of the invention. For example, the shoes 43 were illustrated as being formed from steel and having a bronze friction surface for engaging the cam plate 44. It should be appreciated that solid bronze shoes may be used in place of the steel shoes and that the shoes may be held in contact with the cam plate through a conventional prior art hydraulic hold down system which applies a hold down pressure to the pistons. It also will be appreciated that the cam plate 44 is illustrated as having a fixed angular position. However, the cam plate 44 may be mounted for tilting to provide a variable displacement pump. Furthermore, it will be noted that although the device 10 has been described as a pump, it also may be operated as a motor merely by forcing a flow of pressured hydraulic fluid through the device 10. Various other modifications and changes may be made in the above described device without departing from the spirit and the scope of the claimed invention.

What is claimed is:

1. A fluid pressure energy translating device including a housing having inlet and outlet passages, a stationary port plate mounted in said housing and having inlet and outlet ports communicating with said inlet and outlet passages in said housing, a rotatable cylinder barrel having a first end abutting said port plate, having an axis of rotation perpendicular to said port plate, defining a through bore having a set of straight female splines disposed therein and defining a plurality of cylinders circularly arranged about such axis of rotation, each cylinder having an axis spaced from and parallel to such axis of rotation, a piston in each cylinder, cam means for reciprocating said pistons as said barrel rotates, a drive shaft having a point of maximum deflection, extending coaxially through said bore and rotatably supported in said housing, said drive shaft including a crowned annular surface supporting said barrel opposite said first end and concentric with such axis of rotation and a set of crowned male splines engaging said set of female splines in said barrel, said crowned surface and said set of crowned male splines having centers located on such axis of rotation on opposite sides of said point of maximum radial deflection of said drive shaft.

2. The fluid energy translating device of claim 1, wherein said cam means includes a flat annular cam surface extending about and inclined to such axis of rotation, a separate steel shoe attached through a ball joint to each piston, each shoe having two spaced concentric annular lands formed from a bearing material in contact with said cam surface, the larger diameter one of said lands on each shoe having a plurality of spaced grooves extending radially therethrough, means for supplying a pressurized fluid between each shoe and said cam surface interior to the smaller diameter one of said lands on such shoe, and means for holding said lands on each shoe in contact with said cam surface while said shoes move on said cam surface.

3. The fluid energy translating device of claim 1, wherein said housing comprises a generally tubular housing body, a port cap closing one end of said housing body and a flange mount closing the other end of said housing body.

4. The fluid energy translating device of claim 1, wherein said cam means includes a flat annular cam surface extending about and inclined to such axis of rotation, a separate shoe attached through a ball joint to each piston, said shoes moving on said inclined cam surface to reciprocate said pistons as said barrel is rotated, said ball joints each having a center lying on a plane parallel to said inclined cam surface, such plane intersecting such axis of rotation at a predetermined point, and wherein said crowned bearing is located on said shaft such that said predetermined point lies between the centers of said crowned bearing and said crowned splines.

5. In an axial piston energy translating device of the type including a barrel and a drive shaft having an axis of rotation, said drive shaft extending coaxially through said barrel and having a point of maximum deflection during operation of said device, the improvement comprising a spline connection between said barrel and said drive shaft including a plurality of crowned male splines formed on said drive shaft engaging splines formed on said barrel, said crowned male splines having a center on such axis of rotation to one side of the point of maximum deflection, and a crowned bearing on said drive shaft having a crowned annular surface supporting said barrel concentric with such axis of rotation, said crowned bearing having a center located on such axis of rotation at the opposite side of the point of maximum deflection from said crowned male spline center.

6. In an axial piston energy translating device of the type including a barrel and a drive shaft having an axis of rotation, said drive shaft extending coaxially through said barrel and having a fixed point of maximum radial deflection during operation of said device, said barrel defining a plurality of cylinders circularly spaced about and extending parallel to such axis of rotation and a central through bore coaxial to such axis of rotation, a separate piston located to reciprocate in each cylinder, each piston having a spherical end, and means engaging said spherical piston ends for reciprocating said pistons, said spherical piston ends each having a center with which such centers lying in a plane which intersects such axis of rotation at a predetermined point, the improvement comprising a spline connection between said barrel and said drive shaft including a plurality of crowned male splines formed on said drive shaft engaging splines formed, in said bore said crowned male splines having a center on such axis of rotation to one side of said point of maximum deflection, and a crowned annular surface on said drive shaft positioning said barrel concentric with such axis of rotation, said crowned surface having a center on such axis of rotation at the opposite side of said point of maximum deflection from said crowned male spline center.

* * * * *